US005691754A

United States Patent [19]

Ta

[11] Patent Number: 5,691,754

[45] Date of Patent: Nov. 25, 1997

[54] RIGID TUBE OFF-AXIS INK SUPPLY

[75] Inventor: Chuong C. Ta, San Diego, Calif.

[73] Assignee: Hewlett-Packard Company, Palo Alto, Calif.

[21] Appl. No.: 700,068

[22] Filed: Aug. 19, 1996

[51] Int. Cl.[6] ..... B41J 2/175

[52] U.S. Cl. ..... 347/85

[58] Field of Search ..... 347/84–87, 89, 347/37, 30; 417/547; 74/110

[56] References Cited

U.S. PATENT DOCUMENTS 5,159,348 10/1992 Dietl et al. ..... 347/89

5,367,328 11/1994 Erickson ..... 347/85

*Primary Examiner*—Benjamin R. Fuller

*Assistant Examiner*—Judy Nguyen

[57] ABSTRACT

An ink jet printer that including a movable print carriage, an ink jet printhead cartridge removably supported by the movable print carriage, a stationary ink reservoir located remotely from the ink jet printhead cartridge, a movable ink conveying coupler fluidically coupled to the stationary ink reservoir, and a rigid ink conveying tube connected between the movable ink conveying coupler and the ink jet printhead cartridge, wherein the movable ink conveying coupler moves relative to the stationary ink reservoir as the movable carriage moves along a carriage axis. A ink pump can be driven by the reciprocating motion of the movable ink conveying coupler, and another rigid ink conveying tube be provided to achieve ink recirculation for printhead cooling.

6 Claims, 2 Drawing Sheets

RIGID TUBE OFF-AXIS INK SUPPLY

BACKGROUND OF THE INVENTION

The disclosed invention is generally directed to off-axis ink supply systems for ink jet printers and plotters, and more particularly to an off-axis ink supply system that utilizes rigid ink supply tubes.

Ink jet printers and plotters are well known, and typically include one or more printhead cartridges, each having an ink emitting ink jet printhead and an ink reservoir. The printhead cartridges are supported by a movable print carriage that is reciprocatingly scanned across print media which is advanced between scans of the print carriage.

Since the capacity of a printhead cartridge ink reservoir must necessarily be limited to avoid an excessively large moving mass, and since the useful life of an ink jet printhead is typically greater than the capacity of the printhead cartridge ink reservoir, off-axis or off-line ink delivery systems have been designed wherein an off-axis ink supply is located remotely from the carriage and the printhead cartridge, and is coupled to the printhead cartridge reservoir by a flexible ink conveying tube that is typically made of plastic.

Considerations with the use of flexible ink conveying tubes in off-axis ink delivery systems include gas permeability of plastic which causes bubbles to be introduced, larger product size in order to accommodate the reduced bending capability of flexible tubes of sufficient inside diameter, and difficulty of replacement of the flexible tubes.

SUMMARY OF THE INVENTION

It would therefore be an advantage to provide an ink jet off-axis ink delivery system having tubes that are not gas permeable, do not require bending room, do not require mechanical support, and are easy to replace.

The foregoing and other advantages are provided by the invention in an ink jet printer that includes a movable print carriage, an ink jet printhead cartridge removably supported by the movable print carriage, a stationary ink reservoir located remotely from the ink jet printhead cartridge, a movable ink conveying coupler fluidically coupled to the stationary ink reservoir, and a rigid ink conveying tube connected between the movable ink conveying coupler and the ink jet printhead cartridge, wherein the movable ink conveying coupler moves relative to the stationary ink reservoir as the movable carriage moves along a carriage axis.

In accordance with a further aspect of the invention, a further rigid ink conveying tube is connected between the printhead cartridge and the movable ink conveying coupler, and a pump is driven by the movement of the movable ink conveying coupler.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
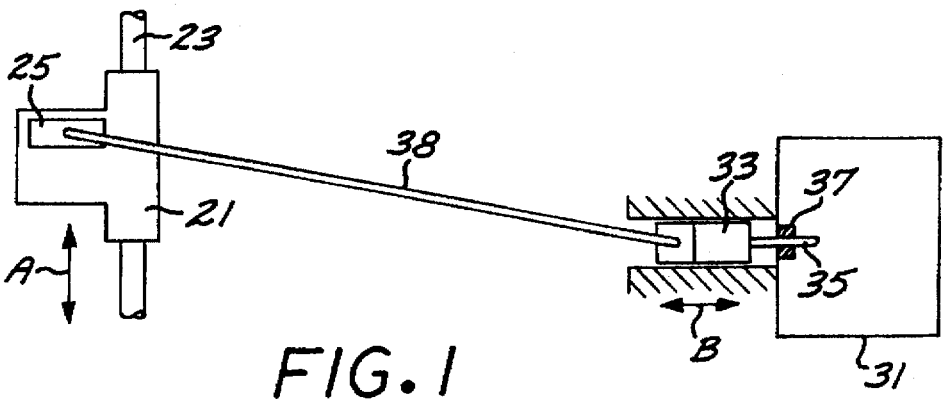
FIG. 1 schematically sets forth a top plan view of an implementation of an ink jet printer that incorporates an off-axis ink delivery system in accordance with the invention.

In the following detailed description and in the several figures of the drawing, like elements are identified with like reference numerals.

Figure 2:
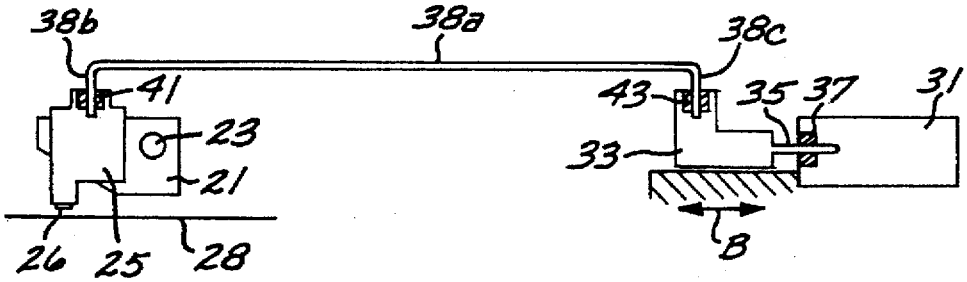
FIG. 2 schematically sets forth a side elevational view of the ink jet printer of FIG. 1.

Referring now to FIGS. 1 and 2, schematically set forth therein are a top plan view and a side elevational view of an implementation of an ink jet printer that incorporates an off-axis ink delivery system in accordance with the invention. The ink jet printer off-axis ink delivery system broadly includes a movable print carriage 21 that is mounted on a guide rail 23 for reciprocating translational movement along a carriage scan axis A. A printhead cartridge 25 is removably retained on the print carriage 21. The printhead cartridge 25 includes a thermal ink jet printhead 26 that fires ink drops downwardly onto a print medium 28.

A stationary remote ink reservoir 31 is located remotely from the printhead cartridges 25, and a movable ink conveying coupler 33 is fluidically coupled to the remote ink reservoir by a pipe 35 that is fixedly attached to the movable ink conveying coupler 33 and slidably engaged in a sliding seal 37 that is incorporated in the stationary ink reservoir 31. The movable ink conveying coupler is suitably supported for reciprocating linear movement along an axis B that is orthogonal to the carriage scan axis A, for example in a track or on a rail, and the pipe 35 and seal 37 are configured so that the translation of the pipe 35 is along the longitudinal axis thereof.

A rigid ink conveying tube 38 is connected between the movable ink conveying coupler 33 and the printhead cartridge 25. The rigid ink conveying tube 38 includes a linear elongated section **38*a*, and short, parallel linear sections 38*b*, 38*c* connected at right angles to the linear elongated section by respective elbow sections. The short section 38*b* of the rigid tube 38 is rotatably engaged in a seal 41 disposed in the top of the printhead cartridge 25 for rotation about the longitudinal axis of the short section 38*b*. The other short section 38*c* of the rigid tube 38 is rotatably engaged in an associated seal 43 disposed in the top of the movable ink conveying coupler 33. The rigid ink conveying tube 38** comprises an aluminum alloy or stainless steel, for example.

In operation, as the carriage 21 reciprocatingly translates along the carriage scan axis A, the short sections **38*b*, 38*c* rotate in the seals 41, 43, and the movable ink conveying coupler 33 reciprocating translates orthogonally to the carriage scan axis A to accommodate the movement of the printhead cartridge 25 along the carriage scan axis. Ink is drawn through the rigid tube 38 into the printhead cartridge 25 by negative pressure in the printhead cartridge 25** that is generated pursuant to the consumption of ink.

While the movable coupler 33 is illustrated as being fluidically coupled to the ink reservoir 31 by a pipe that slides in a seal 37, it should be appreciated that a flexible conduit can be utilized to accommodate the movement of the movable coupler 33.

Figure 3:
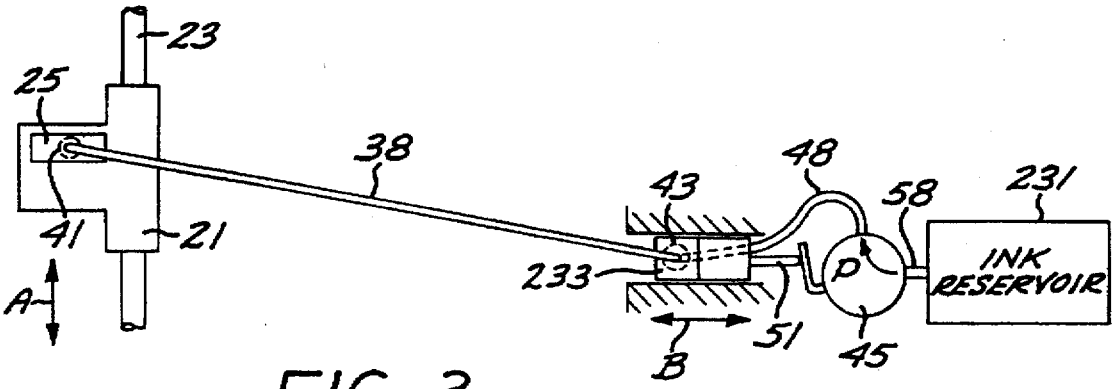
FIG. 3 schematically sets forth a top plan view of an implementation of an ink jet printer that incorporates an off-axis ink delivery system in accordance with the invention which includes a pump.

Referring now to FIG. 3, to the extent that a pump is needed to supply sufficient ink to the printhead cartridge 25, for example in relatively high consumption applications, a pump 45 can be coupled between a rigid ink conveying tube 38 and a stationary remote ink reservoir 231. The rigid ink conveying tube 38 includes a short angled section, similarly to the short section 38*c* of the rigid tube 38 of FIGS. 1 and 2, that is rotatably disposed in the top of a movable coupler 233, for example in a suitable bushing. The output of the pump 45 is connected to a short angled section of the rigid ink conveying tube 38 by a conduit 48 which includes a flexible tube portion that accommodates the movement of the movable coupler 33, and a conduit 58 is connected between the input of the pump 45 and a stationary remote ink reservoir 231. The pump 45 is actuated by an actuating rod 51 that is connected between the movable coupler 33 and the pump 45, whereby the pump 45 is driven by the reciprocating motion of the movable coupler 33. Alternatively, the pump 45 can comprise an electrically actuated pump.

Figure 4:
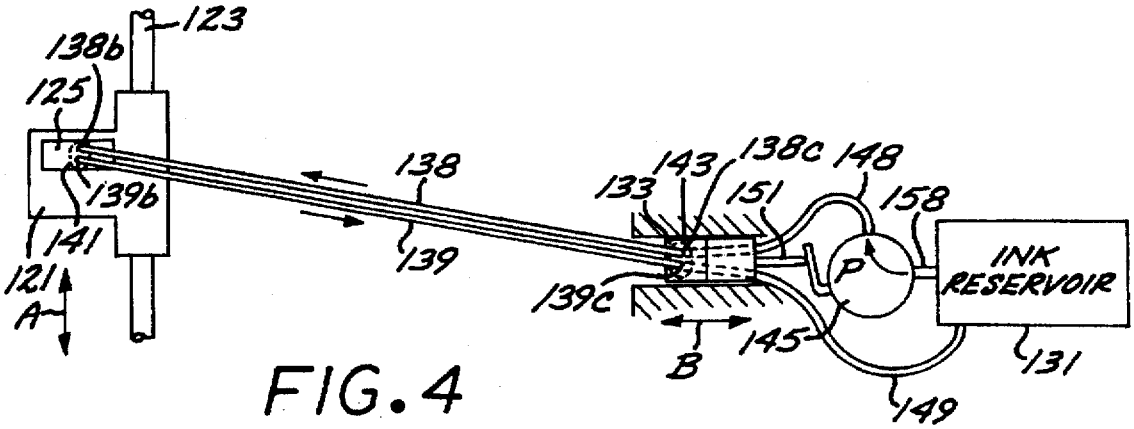
FIG. 4 schematically sets forth a top plan view of an implementation of an ink jet printer that incorporates a further off-axis ink delivery system in accordance with the invention.
Figure 5:
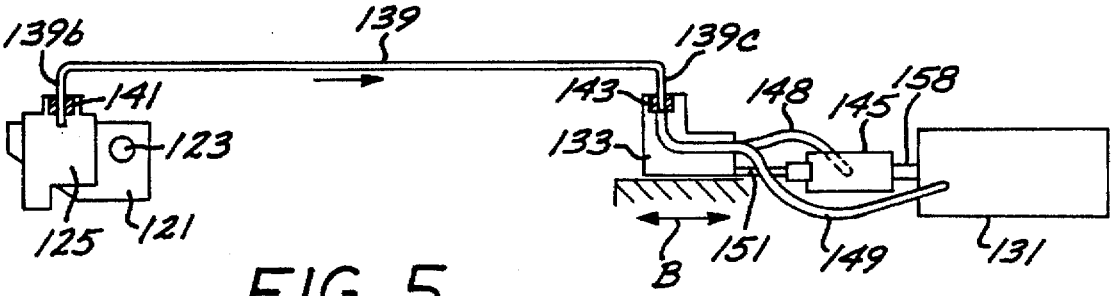
FIG. 5 schematically sets forth a side elevational view of the ink jet printer of FIG. 4.

Referring now to FIGS. 4 and 5, schematically set forth therein are a top plan view and a side elevational view of another implementation of an off-axis continuous ink delivery system in accordance with the invention. The ink jet printer off-axis continuous ink delivery system broadly includes a movable print carriage 121 that is mounted on a guide rail 123 for reciprocating translational movement along a carriage scan axis. A printhead cartridge 125 is removably retained on the print carriage 121.

A pair of parallel, equal length ink conveying tubes 138, 139 are connected between the printhead cartridge 125 and a movable coupler 133 that is suitably supported for reciprocating linear movement along an axis that is orthogonal to the carriage scan axis, for example in a track or on a rail. The rigid ink conveying tube 138 comprises an ink supply tube, for example, while the rigid ink conveying tube 139 comprises an ink return tube. Each of the rigid ink conveying tubes 138, 139 is substantially similar to the rigid ink tube 38 of the ink jet printer of FIGS. 1 and 2. Each of the rigid ink conveying tubes 138, 139 thus includes a linear elongated section and short parallel linear sections connected at right angles to the linear elongated section by respective elbow sections. The short sections 138*b*, 139*b* of the rigid tubes 138, 139 are rotatably engaged in a seal 141 disposed in the top of the printhead cartridge 125, while the short sections 138*c*, 139*c* of the rigid tubes 138, 139 are rotatably engaged in a bushing 143 in the top of the movable coupler 133. Preferably, the rotational centers of the short sections 138*b*, 139*b* are collinear on a line that is parallel to the carriage axis A; the rotational centers of the short sections 138*c*, 139*c* are collinear on a line that is parallel to the carriage scan axis A; and the elongated sections of the rigid tubes 138, 139 are of substantially equal length. In this manner, the short sections of the rigid tubes 138, 139 rotate at the vertexes of a parallelogram.

The ink delivery tube 138 is fluidically connected to the output of a pump 145 by a conduit 148 which includes a flexible tube portion that accommodates the movement of the movable coupler 133. A conduit 158 is connected between the input of the pump 145 and a stationary remote ink reservoir 131 associated with the printhead cartridge 125. The stationary remote ink reservoir 131 is located remotely from the printhead cartridge 125. The pump 145 is actuated by an actuating rod 151 that is connected between the movable coupler 133 and the pump 145, whereby the pump is driven by the reciprocating motion of the movable coupler 133. Alternatively, the pump 145 can comprise an electrically actuated pump.

The ink return tube 139 is fluidically connected to the stationary remote ink reservoir 131 by a conduit 149 which includes a flexible tube portion that accommodates the movement of the movable coupler 133.

In operation, the reciprocating motion of the print carriage 121 causes the movable coupler 133 to move reciprocatingly, which in turn causes the pump 145 to pump ink to the printhead cartridge 125 via the ink output tube 138. The ink provided to the printhead 125 via the ink delivery tube 138 exceeds the amount of ink consumed by the printhead 125, and the excess ink is returned via the rigid ink return tube 139.

The ink delivery system of FIGS. 3 and 4 is thus a recirculating system wherein ink is continually recirculated. Pursuant to recirculation, components including the ink, the rigid ink tubes 138, 139, the movable coupler 133, the conduits 148, 149, and the remote stationary ink reservoir 131 function as a heat exchanger that cools the printhead 125 by transferring heat from the printhead to the ambient air.

The foregoing has thus been a disclosure of an ink jet off-axis ink delivery system that utilizes rigid non-gas permeable ink delivery tubes that advantageously avoids introducing gas bubbles into the ink and the need to mechanically support flexible tubes ink delivery tubes, and which further advantageously allows for a smaller produce size and ease of replacement.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printer comprising:

a movable print carriage;

an ink jet printhead cartridge removably supported by said movable print carriage;

a stationary ink reservoir located remotely from said ink jet printhead cartridge;

a movable ink conveying coupler fluidically coupled to said stationary ink reservoir; and a rigid ink conveying tube connected between said movable ink conveying coupler and said ink jet printhead cartridge;

wherein said movable ink conveying coupler (a) moves relative to said stationary ink reservoir as said movable carriage moves along a carriage axis, and (b) moves orthogonally to the carriage axis.

2. The ink jet printer of claim 1 wherein said rigid tube comprises a metal tube.

3. The ink jet printer of claim 1 wherein said rigid tube comprises an elongated linear tube and first and second parallel short tubes attached orthogonally to said elongated linear tube.

4. The ink jet printer of claim 1 further including a pump that is fluidically coupled between said stationary ink reservoir and said rigid ink conveying tube.

5. The ink jet printer of claim 4 wherein said pump is driven by the movement of said movable coupler.

6. The ink jet printer of claim 4 further including another rigid ink conveying tube connected between said movable ink conveying coupler and said ink jet printhead cartridge.

* * * * *